US007740137B2

(12) United States Patent
Rocco

(10) Patent No.: US 7,740,137 B2
(45) Date of Patent: Jun. 22, 2010

(54) BEVERAGE INDICATING CONTAINER

(76) Inventor: Thomas Rocco, 28-28 College Point Blvd., Flushing, NY (US) 11354

( * ) Notice: Subject to any disclaimer, the term of this patent is extended or adjusted under 35 U.S.C. 154(b) by 140 days.

(21) Appl. No.: 11/772,677

(22) Filed: Jul. 2, 2007

(65) Prior Publication Data

US 2008/0083637 A1 Apr. 10, 2008

Related U.S. Application Data

(60) Provisional application No. 60/847,036, filed on Sep. 25, 2006.

(51) Int. Cl.
*B65D 85/00* (2006.01)
*G09F 3/02* (2006.01)
*G09F 9/00* (2006.01)

(52) U.S. Cl. ..... 206/459.1; 40/306; 116/317; 206/217

(58) Field of Classification Search ..... 206/217–218, 206/459.1, 459.5; 40/2, 306, 324; 116/308, 116/309, 317
See application file for complete search history.

(56) References Cited

U.S. PATENT DOCUMENTS 2,685,860 A * 8/1954 Plakas ..... 206/459.1
3,818,858 A * 6/1974 Kramer et al. ..... 116/308
4,621,670 A * 11/1986 Yuen ..... 206/459.1
4,630,733 A * 12/1986 Fear ..... 206/459.1
4,805,775 A * 2/1989 Fear ..... 206/459.1
4,877,119 A * 10/1989 Hosking ..... 206/459.1
4,960,206 A * 10/1990 Johannes ..... 206/459.1
5,520,278 A * 5/1996 Hughes ..... 206/217
5,839,581 A * 11/1998 Vagedes ..... 206/459.1
7,243,795 B2 * 7/2007 Gold et al. ..... 206/459.5
2006/0101680 A1 * 5/2006 Smith ..... 40/324
2008/0138477 A1 * 6/2008 Mular et al. ..... 206/459.1

* cited by examiner

*Primary Examiner*—Bryon P Gehman
(74) *Attorney, Agent, or Firm*—The Farrell Law Firm, LLP

(57) ABSTRACT

A liquid-container assembly for indicating the contents contained therein is provided. The assembly preferably includes a liquid-container body for holding liquid, with a horizontal base and an outer wall structure extending upwardly from the base, where an upper portion of the wall defines an open top rim; a plurality of liquid-indicia being disposed about the periphery of the outer wall of the container body; and a lid covering the open top rim of the assembly. The lid has a tab that may be used as a pointer for selecting liquid-indicia, and therefore, visually displays the contents contained in the liquid-container.

3 Claims, 6 Drawing Sheets

BEVERAGE INDICATING CONTAINER

PRIORITY

This application claims priority under 35 U.S.C. §119(a) to a U.S. provisional application entitled "Beverage Indicating Container" filed in the United States Patent and Trademark Office on Sep. 25, 2006 and assigned Application No. 60/847,036, the entire contents of which are incorporated herein by reference.

BACKGROUND OF THE INVENTION

1. Field of the Invention

The present invention relates to a liquid container assembly, and in particular to a container and lid assembly having indicia for indicating the contents of the container.

2. Description of the Prior Art

When a consumer orders a hot or cold drink from a coffee shop or a donut shop, it is often necessary to mark the container in order to identify the consumer's selected choice from the menu of beverages offered by the shop. For instance, the shop might have on its menu: coffee, tea, decaffeinated coffee and tea, with sugar or no sugar, etc. Conventionally, in order to differentiate between these selections the store employee would use pen or pencil and mark the cup according to the customer's selection. However, this conventional marking system is time consuming, inconvenient and often gives rise to numerous errors, due to the employee's poor hand writing. Furthermore, additional problems may arise due to loss or malfunctioning of writing implements.

Other containers may provide pre-printed indicia on the cup, which needs to be marked by the store employee, or pre-molded markers on the plastic lid or cover of the container.

SUMMARY OF THE INVENTION

Accordingly, the present invention has been made to solve the above-mentioned problems occurring in the conventional art. An object of the present invention is to provide an improved liquid-container, for identifying the liquid contained in the container, without the need for writing or marking the container using pen or pencil.

It is a further object of the present invention to provide a liquid-container assembly, for indicating the contents of the container without using any external markers.

According to present invention, there is provided a liquid-container including a container body, such as a cup configured for holding a liquid with a horizontal base, an outer wall structure extending upwardly from the base, where upper portion of the wall define an open top; and a lid for covering the open top of the beverage container, wherein the lid includes a tab that may be used as a pointer.

Furthermore, the container of present invention has a plurality of liquid-identifying indicia, each one different from the others, but including for example, "coffee", "tea", "regular", "decaf", "sugar" and "no sugar", disposed on a periphery of the upper part of the outer wall of the container body for indicating the contents of the liquid contained within the container, wherein the indicia is spaced apart from one another such that when the lid is fitted on the open top of the container, and rotated in intervals of between ranges of 30 to 60 degrees, the tab aligns with and points to a selected indicia marking, to thereby identify the contents of said liquid-container.

BRIEF DESCRIPTION OF THE DRAWINGS

The above and other objects, features and advantages of the present invention will be more apparent from the following detailed description, taken in conjunction with the accompanying drawings, in which.

DETAILED DESCRIPTION OF THE PREFERRED EMBODIMENTS

Preferred embodiments of the present invention will now be described in detail with reference to accompanying drawings.

Figure 1:
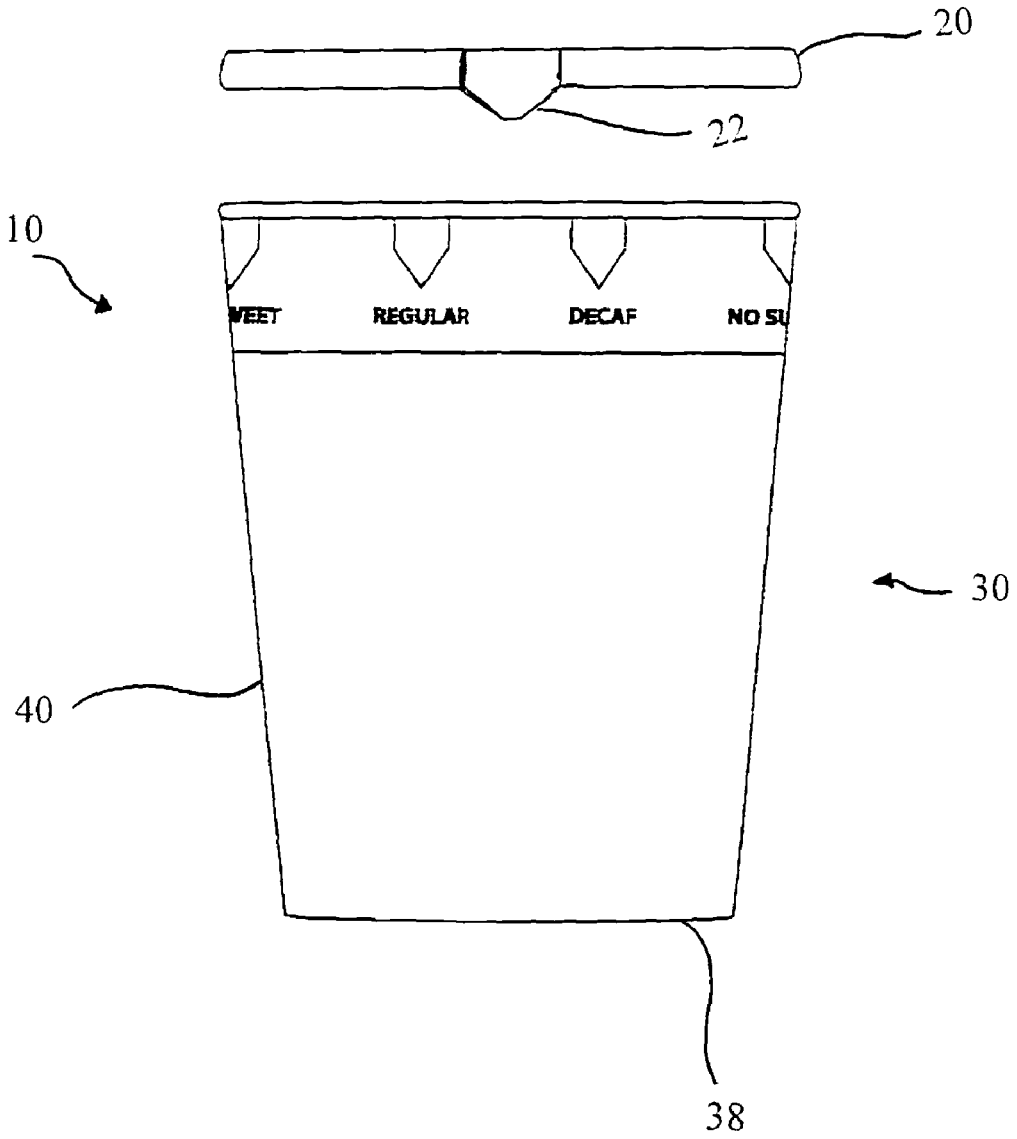
FIG. 1 is an exploded plan view illustrating a lid with a tab, and a liquid-container with a plurality of liquid-indicia in accordance with present invention.
Figure 1A:
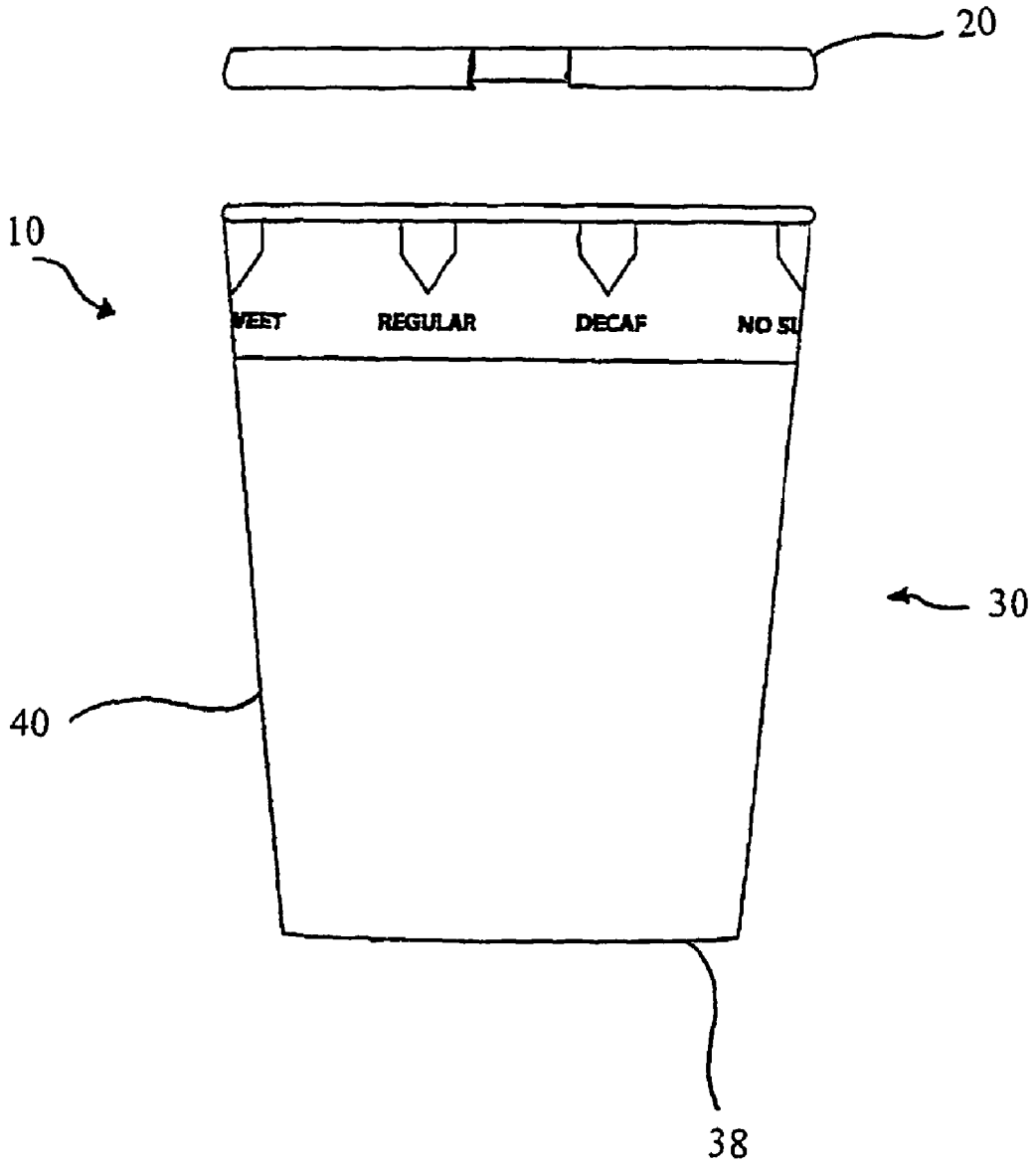
FIG. 1A is an exploded plan view illustrating the lid and liquid-container of FIG.1, in which the tab is removed.
Figure 2:
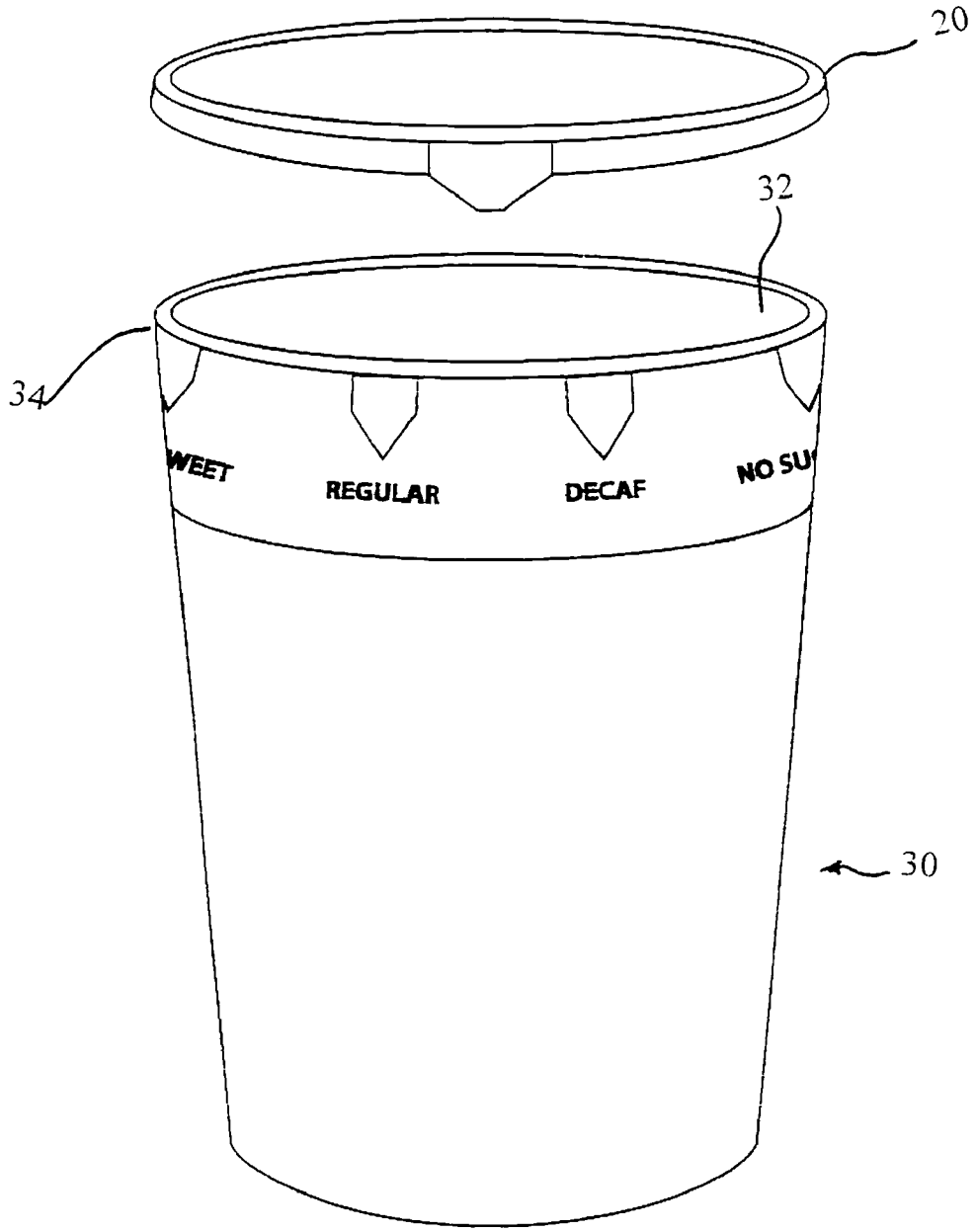
FIG. 2 is an exploded perspective view illustrating the lid and the liquid-container of FIG. 1.

Referring to FIGS. 1, 1A, and 2, a beverage container assembly 10 includes a liquid-container body 30, and a lid 20, where the body 30 has a plurality of liquid-indicia markings 36.

The liquid-container body 30, e.g., a cup, defines an inner chamber 32, as shown in FIG. 2, configured for holding a liquid with a horizontal base 38, and an outer wall 40 extending upwardly from the base 38, where upper end of the outer wall 40 defines an open top having a rim 34, shown in FIG. 2.

According to the present invention, an indicator system is provided, that utilizes a lid having a tab or drink opening that can be used as a pointer. The lid 20 is positioned to cover the open top rim 34 of the liquid-container body 30, wherein the lid 20 has a peripheral tab 22, which is removable to define a drink opening, extending from the periphery. FIG. 1A illustrates the beverage containder assembly 10 of FIG. 1 in which the peripheral tab 22 is removed. Tab 22 may be used as a pointer to align with one of the indicia, to indicate the contents of the container.

The plurality of liquid indicia 36, e.g., "regular", "decaf", "sweet", and "no-sugar", are for indicating the contents contained within the inner chamber 32 of the liquid-container body 30, and preferably each of the plurality of liquid-indicia 36 are different from the others.

Figure 3:
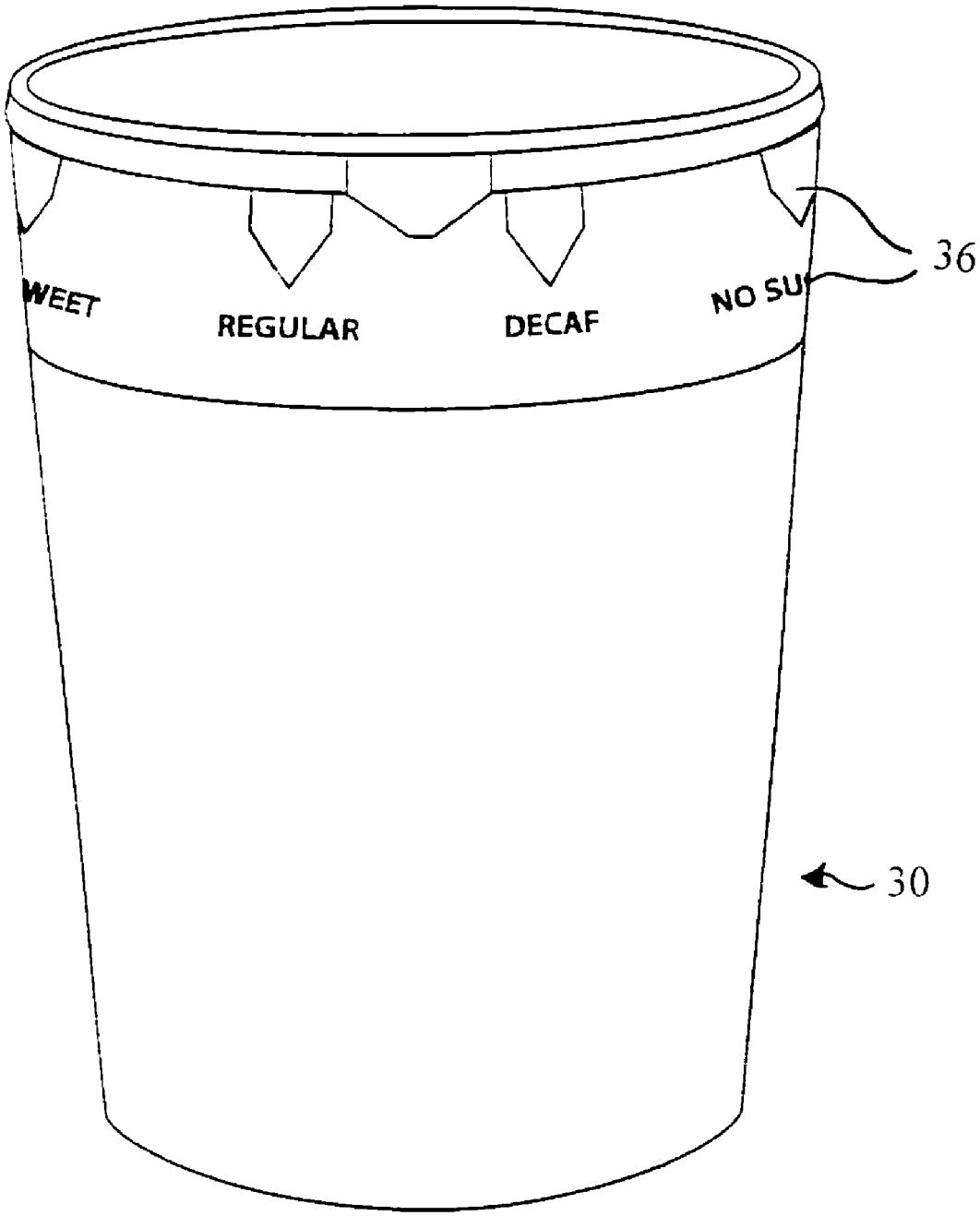
FIG. 3 is a perspective view of the assembled liquid-container with plurality of liquid-indicia and the lid shown in FIGS. 1 and 2.
Figure 4:
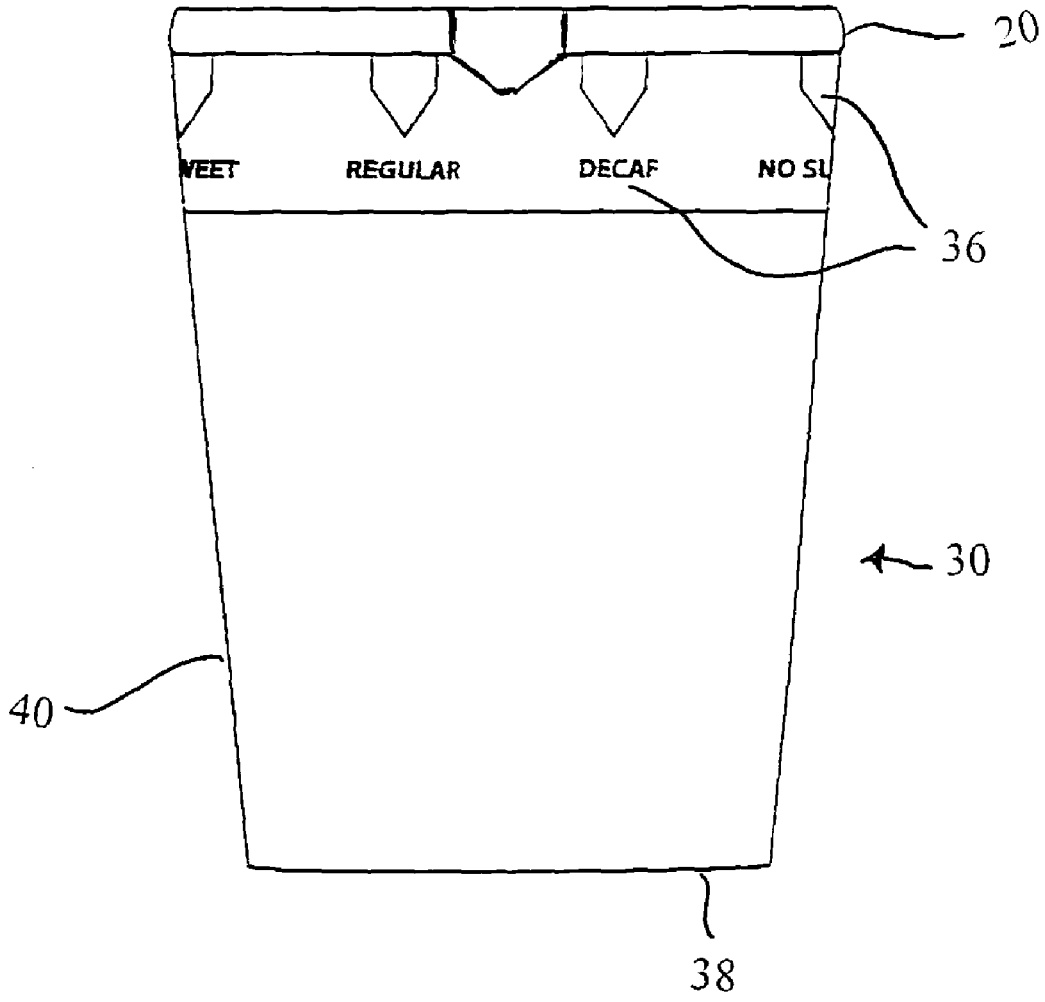
FIG. 4 is plan view of the assembled liquid-container with the lid fitted on the container with plurality of liquid-indicia in accordance with present invention.
Figure 5:
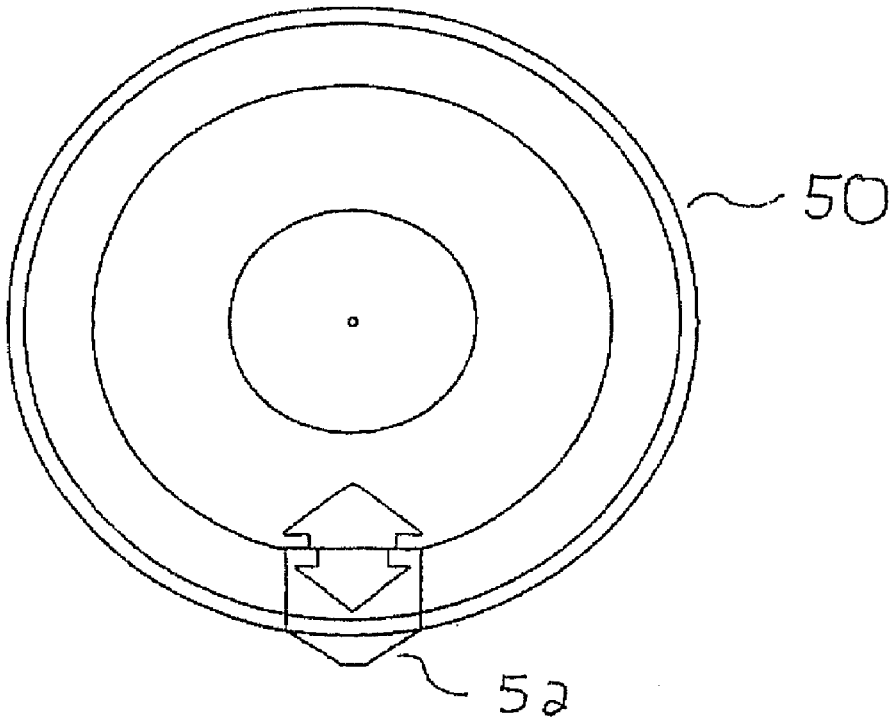
Figure 6:
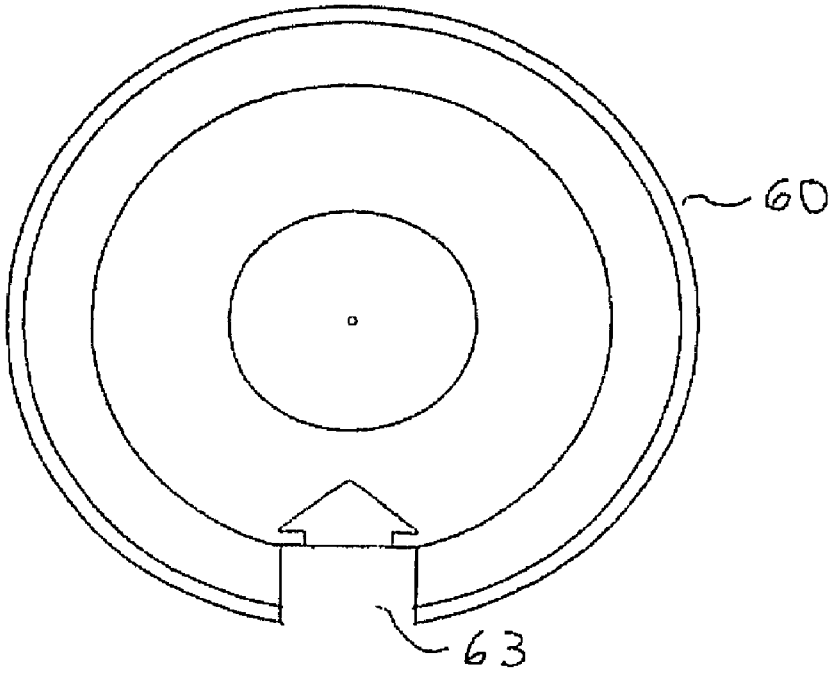

Referring to FIGS. 3 and 4, the plurality of liquid-indicia 36 are spaced apart from one another in such a manner that when the lid is fitted on the rim 34, of the liquid-container body 30, the tab 22 may be aligned with a selected indicia, although it is noted that in the Figures, the tab 22 is shown between respective indicia, to provide visual clarity, for purposes of discussion. Preferably, the indicia are separated by 30 to 60 degrees, to clearly differentiate selected indicia, and to thereby identify the contents of said container body 30, although any degree of separation may be used. As shown in FIG. 3, the plurality of liquid-indicia 36 are positioned at a distance under the rim 34, so as not to be obscured by the lid 20, when the lid is fitted over the rim 34. Thereby, a server may conveniently view and indicate the contents contained in the container body 30, while eliminating the need to use any writing tools, e.g., pen, pencil, etc.

While the present invention has been shown and described with reference to a certain preferred embodiment thereof, it will be understood by those skilled in the art that various changes in form and details may be made therein without departing from the spirit of the invention defined by appended claims.

What is claimed is:

1. A liquid-container assembly, comprising:

a container with a horizontal base;

a wall structure extending upwardly from the base, where the upper portion of the wall structure defines an open top;

a lid for covering the open top of the liquid-container assembly, the lid having a tab to indicate the contents of the liquid-container assembly; and a plurality of liquid-indicia markings disposed on a periphery of the wall structure of the container, wherein the tab of the lid aligns with one of the liquid-indicia markings to provide a visual indication of the contents of the liquid-container assembly, and wherein the tab is made to be movable in order to provide an opening in the lid through which the contents of the liquid-container assembly may be removed.

2. The liquid-container assembly of claim 1, wherein each of the liquid-indicia markings indicates a type of liquid that may be contained by the container as the contents of the liquid-container assembly, wherein each of the liquid-indicia markings is different from the other liquid-indicia markings.

3. The liquid-container assembly of claim 2, wherein the liquid-indicia markings are spaced from one another in a range of 30 to 60 degrees, such that when the lid is fitted on the open top of the liquid-container assembly, the tab points to a selected indicia marking, to thereby identify the contents of said liquid-container assembly.

* * * * *